United States Patent [19]

Ascoli

[11] 4,012,837

[45] Mar. 22, 1977

[54] DRY SHAVERS

[75] Inventor: Enzo Ascoli, Lausanne, Switzerland

[73] Assignee: The Gillette Company, Boston, Mass.

[22] Filed: June 23, 1975

[21] Appl. No.: 589,209

[30] Foreign Application Priority Data

July 23, 1974 United Kingdom ..... 32448/74

[52] U.S. Cl. ..... 30/43.9; 30/43.92; 30/346.51

[51] Int. Cl.[2] ..... B26B 19/04; B26B 19/12

[58] Field of Search ..... 30/43.4–43.92, 30/346.51

[56] References Cited

UNITED STATES PATENTS

| | | | |
|---|---|---|---|
| 2,183,442 | 12/1939 | Blackwell | 30/41.5 |
| 2,218,312 | 10/1940 | Gardner | 30/346.51 X |
| 2,296,134 | 9/1942 | Wright | 30/43.92 |
| 2,700,816 | 2/1955 | Winther | 30/43.6 |
| 2,943,390 | 7/1960 | Panza | 30/43.6 |
| 2,952,908 | 9/1960 | Starre | 30/346.51 X |
| 2,982,020 | 5/1961 | Bulova | 30/43.9 |
| 3,213,301 | 10/1965 | Jepson | 30/43.9 |
| 3,360,857 | 1/1968 | Fortenberry | 30/43.6 X |

*Primary Examiner*—Gary L. Smith
*Attorney, Agent, or Firm*—Flynn & Frishauf

[57] ABSTRACT

An electric shaver having a shaving foil and a movable inner cutter cooperating therewith, wherein the inner cutter comprises a cutter body and a plurality of cutter blades mounted thereon, each cutter blade comprising integrally formed first and second parts lying in a single plane, the first part having a cutting edge and the second part providing an abutment against the cutter body, the second part being resiliently deformable relative to the first part in the plane of the blade and being so deformed by assembly of the inner cutter beneath the shaving foil so that the cutter edge is resiliently urged into engagement with the foil.

11 Claims, 4 Drawing Figures

DRY SHAVERS

FIELD OF THE INVENTION

This invention relates to a dry shaver, and more particularly to a cutter assembly therefor of the kind in which cutter blades are resiliently urged into engagement with shaving foil relative to a cutter body on which the blades are mounted. The invention also relates to a cutter blade for such a cutter assembly.

PRIOR ART

In a known cutter assembly of this general kind, for a shaver having a cutter head mounted for arcuate oscillation about the axis of a cylindrically curved shaving foil, three cutter blades are pressed radially outwards relative to a supporting guide structure by means of a forked spring plate which is preformed with a flat stem and three flat arms extending in parallel relationship away from the stem at an angle to the phane thereof. The stem is secured to the supporting guide structure parallel to the cutter axis so that the arms are inclined outwardly to press against the inner edges of the respective cutter blades. The supporting guide structure is carried by rubber mountings to permit arcuate vibration of the cutter assembly.

This known arrangement has various disadvantages, and in particular, is not useful when a considerably larger number of cutter blades are to be used. Hitherto, in the case of cutter assemblies having large numbers of blades, the cuter body carrying the blades has been urged outwardly by means of one or more springs. However, this arrangement leads to deficiencies in shaving action.

OBJECT OF THE INVENTION

It is a main object of the present invention to provide an improved cutter assembly of the kind described.

SUMMARY OF THE INVENTION

According to one aspect of the invention, there is provided an electric shaver having a shaving foil and a movable inner cutter cooperating therewith, wherein the inner cutter comprises a cutter body and a plurality of cutter blades mounted thereon, each cutter blade comprising integrally formed first and second parts lying in a single plane, the first part having a cutting edge and the second part providing an abutment against the cutter body, the said second part being resiliently deformable relative to the said first part in the plane of the blade and being so deformed by assembly of the inner cutter beneath the shaving foil so that the cutting edge is resiliently urged into engagement with the foil.

The shaver preferably has a cylindrically curved foil and the inner cuter is mounted for arcuate oscillation or rotation about the axis of the foil. In this case the cutter preferably comprises a cutter body having longitudinal slots directed radially with respect to the axis of arcuate oscillation or rotation, the cutter blades being received in and urged outwardly of said slots, the first part of each blade having a straight cutting edge for engagement with the foil.

However, the invention may also be applied to a shaver in which the inner cutter is mounted for linear reciprocation beneath a cylindrically curved shaving foil. In this case the cutter body may be provided with transverse slots in which the blades are received and urged outwardly thereof to engage the foil, the first part of each blade having a circularly curved cutting edge.

According to another aspect of the invention, there is provided a cutter blade for the movable inner cutter of a dry shaver having an outer shaving foil, said cuter blade comprising integrally formed coplanar first and second parts, the first part being substantially rigid and being formed with a cutting edge for cooperation with the foil, and the second part being resiliently deformable relative to the first part, towards the cutting edge in the plane of the blade.

In a preferred embodiment, the first and second parts of a cutter blade are connected by an integrally formed bridge in the region of the centre of the length of the cutting edge, and on each side of the bridge the two parts extend away from the bridge in spaced relationship in the plane of the cutting edge. Thus, for use in a shaver having an arcuately oscillating or rotating inner cutter, the blade will comprise first and second generally straight parallel spaced arms connected by a bridge midway of their lengths, while for use in a shaver having a linearly reciprocating inner cutter the blade will comprise a sector-shaped first part joined by a bridge to a second part in the form of a generally straight arm.

The resilient second part is conveniently formed with projecting abutments for pressing against the bottom of the slot in the cutter body when the inner cutter is assembled beneath the foil, thereby to cause the required deformation of said resilient second part of the blade, whereby the rigid first part of the blade is urged outwardly of the slot so that the cutting edge is urged against the shaving foil with subsantially uniform contact pressure along the length of said cutting edge. Alternatively, the abutments may be provided on the cutter body.

The blade is conveniently made of tempered steel, for example stamped from steel sheet of uniform thickness, the first and second parts being dimensioned in the plane of the blade, in particular in respect of the dimensions in the direction transverse to the length of the cutting edge as compared to the dimensions along the length of the blade, to impart the necessary rigidity to the first part and the necessary resilience to the second part.

In the assembled shaver, the deformation of the respective second parts of the blades mounted on the cuttter body is produced by application of a detachable foil head to the shaver casing. The cutter body is preferably provided with releasable clips to prevent the baldes from being fully ejected from the slots in the cutter body when the foil head is removed.

BRIEF DESCRIPTION OF DRAWINGS

A practical embodiment of dry shaver and cutter blades therefor in accordance with the invention will now be described by way of example with reference to the accompanying drawings, in which.

DESCRIPTION OF EMBODIMENTS

Figure 1:
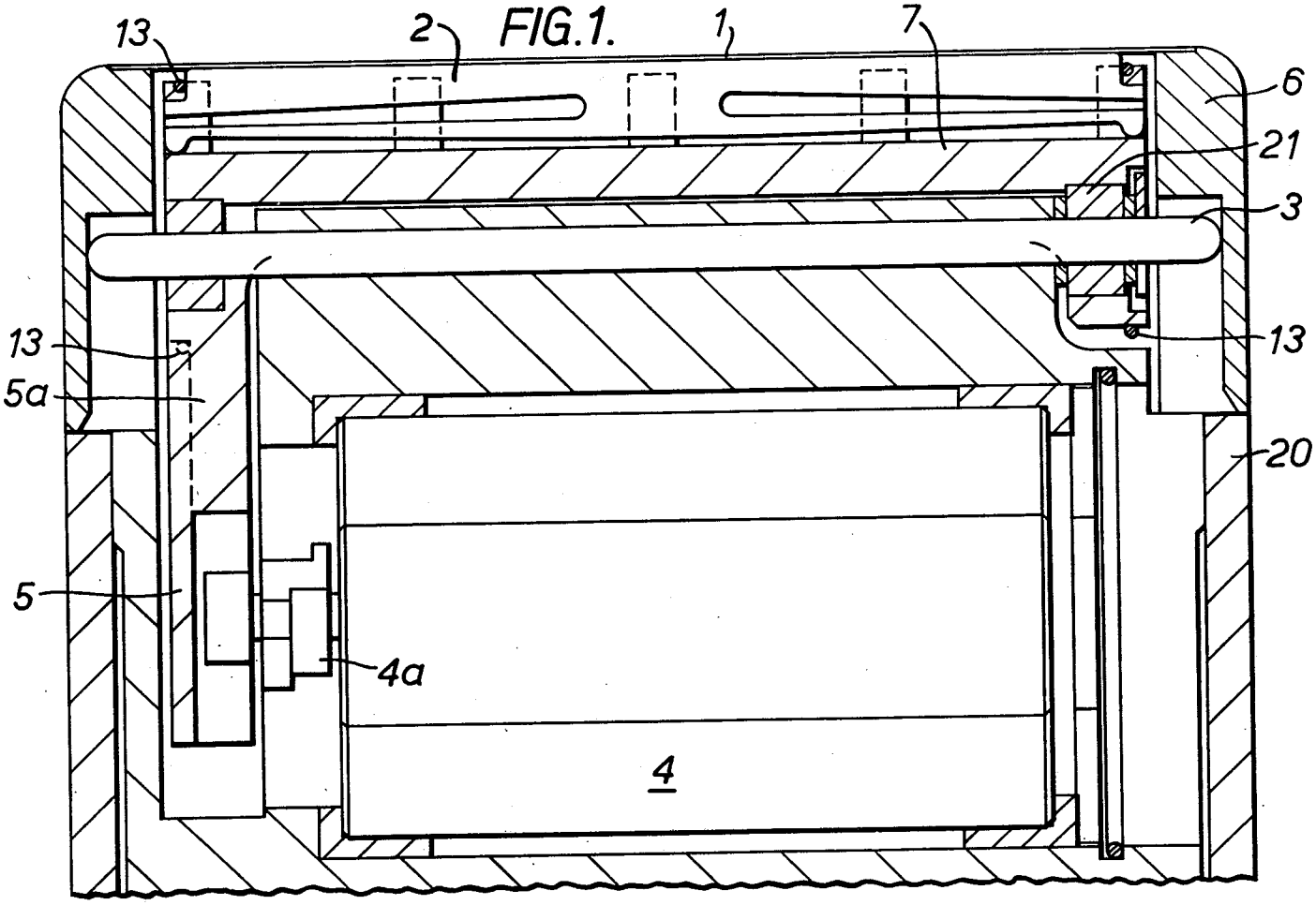
FIG. 1 shows the operative part of a dry shaver through a section in a plane through the axis of a cutter head.
Figure 2:
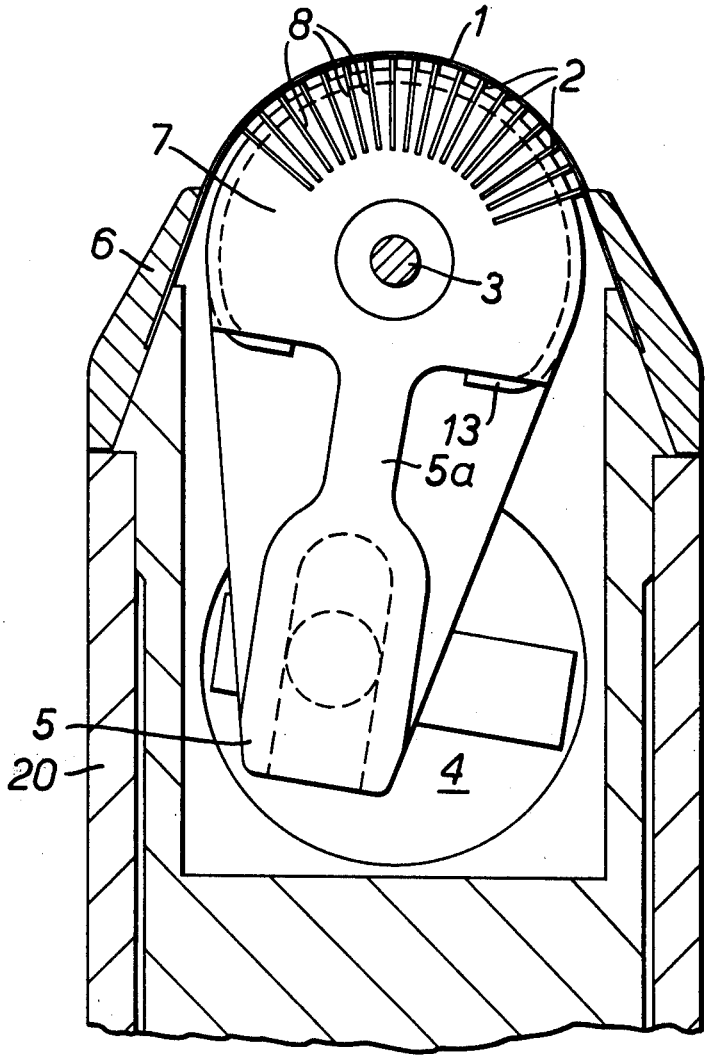
FIG. 2 shows the operative part of the shaver in transverse section.

As shown in FIGS. 1 and 2, the dry shaver comprises a cutter body 7 mounted for arcuate oscillation about a spindle 3 beneath a cylindrically curved shaving foil 1. Reference 21 indicates bearings for the spindle 3. The foil 1 is carried by a foil head 6 which is detachably secured to the casing 20 of the shaver.

within the casing is provided an electric motor 4 having a rotary output shaft 4*a* which imparts the required arcuate oscillation to the cutter body 7 through a transmission mechanism 5. The arrangement of the transmission mechanism forms no part of the present invention and will not be described. This mechanism 5 incorporates a level 5*a* which is integrally formed with the cutter body 7, being moulded therewith of plastic material.

The cutter body 7 is also formed with a plurality of longitudinal slots 8 directed radially with respect to the axis of arcuate oscillation of the inner cutter. These slots 8 receive a series of cutter blades 2 which are urged outwardly of the slots to engage the shaving foil 1, as subsequently described. The cutter body is provided with releasable clips 13 which prevent the blades from being ejected from the slots 8 when the foil head 6 is removed.

Figure 3:
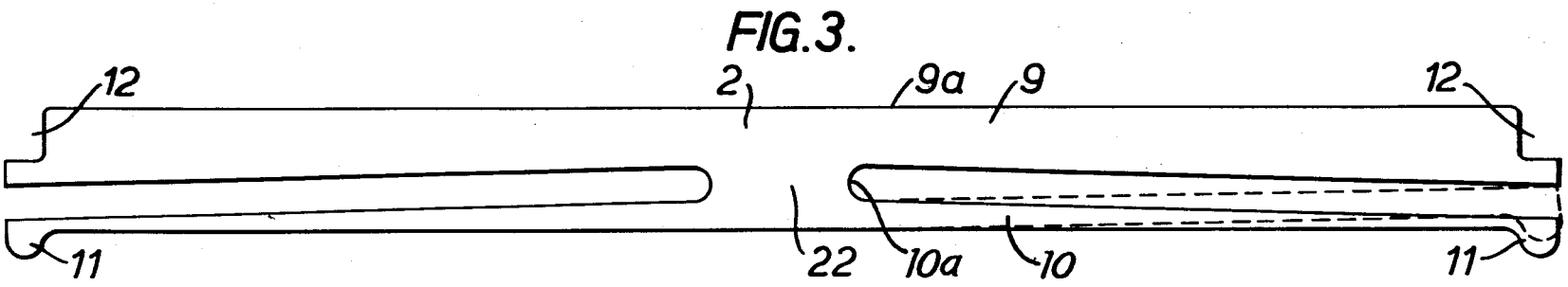
FIG. 3 shows a blade for the cutter head.

Referring now to FIG. 3, each blade 2 comprises an integral structure having two parts, a substantially rigid first part 9 carrying the cutting edge 9*a* connected by a bridge 22 to a resilient second part 10. When the foil head 6 is applied to the shaver casing 20, the blade is depressed in its slot 8 in the cutter body and the resilient part 10 is deformed, whereby by reaction the rigid part 9 is urged towards the secured foil head 6 so that the cutting edge 9*a* is pressed against the foil 1 with substantially uniform pressure along the length of the cutting edge. The deformed condition of the resilient part of the blade is indicated by broken lines on the right-hand side in FIG. 3.

In more detail, the blade 2 consists of a generally straight rigid arm 9 carrying the cutting edge 9*a* and a generally straight resilient arm 10 extending generally parallel to and in spaced relationship to the rigid arm 9 in the undeformed condition of said resilient arm, the two arms being connected by the bridge 22 midway of their lengths. The blade is made of tempered steel, for example stamped from a steel sheet of uniform thickness, and the two arms are dimensioned in the plane of the blade, in particular in respect of the dimensions in the direction transverse to the lengths of the cutting edge 9*a* as compared to the dimensions along the length of the blade, to impart the necessary rigidity to the first part 9 and the necessary resilience to the second part 10. The free ends of the first arm 9 are provided with recesses 12 to accommodate the above-mentioned detachable clips 13 on the cutter body. The free ends of the resilient arm 10 are formed with projecting abutments 11 which, in the assembled shaver, are pressed against the bottom of the slot 8 in the cutter body to cause the necessary deformation of the resilient part, whereby by reaction the cutting edge 9*a* of the rigid part is urged into engagement with the foil 1 of the secured foil head 6.

The relative dimensions of the blade 2 are clearly very important to achieve the optimum result in which the cutting edge is urged against the foil with an appropriate uniform pressure along the length of the cutting edge. The relative dimensions for one praftical construction of blade appear from FIG. 3, which is drawn substantially to scale. It will be noticed that the rigid arm 9 is substantially wider than the resilient arm 10 in the direction transverse to the cutting edge 9*a*, and also that whereas the rigid arm is tapered along its edge adjacent the resilient arm so that this arm increases in width towards its free ends, the resilient arm is correspondingly tapered along its edge adjacent the rigid arm so that this arm becomes narrower in width towards its free ends. The tapering of the resilient arm 10 is desirable to ensure that this arm, when deformed, is subjected to a bending strain which is substantially uniform along the length of the arm. The curved radius 10*a* at the side edges of the bridge 22 is important to reduce risk of fracture of the resilient arm when it connects to the bridge.

The steel blade construction shown in FIG. 3 may be tempered either before or after stamping. It is necessary to correct deformation, produced by the stamping operation at the cutting edge of the blade, for example by use of a milling machine.

It should be mentioned, however, that the blades can be made in ways other than by stamping, for example etching using photoresist techniques, and also that the blades can be made of materials other than tempered steel. One convenient alternative material is beryllium-bronze alloy.

The preferred shape for the resilient arm of the blade is determined by computation in a computer, which is programmed with the elasticity modules of the blade material, the length of the blade, the required spring pressure and the requirement for constant bending strain along the length of the resilient arm, and provides an output in the form of a width function determining the appropriate tapering shape for the resilient arm.

By way of example, the tempered steel blade shown in FIG. 3 has the following dimensions:

| | | |
|---|---|---|
| Overall length: | 44 | mm |
| Length of cutting edge: | 41.8 | mm |
| Length of bridge: | 5 | mm |
| Length of rigid arm (= length of resilient arm) to either side of bridge: | 19.5 | mm |
| Separation of rigid arm and resilient arm (= width of bridge): | 1 | mm |
| Radius at sides of bridge: | 0.5 | mm |
| Width of resilient arm: | 0.82 | mm to 0.33 mm |
| Width of rigid arm: | 1.7 | mm to 2.3 mm |
| Increasing taper of rigid arm (= decreasing taper of resilient arm): | 2.733% | |
| Depth of projecting abutments: | 0.8 | mm |
| Radius of abutments: | 0.5 | mm |

Of course, different dimensions will be appropriate to a blade made of material other than tempered steel.

Figure 4:
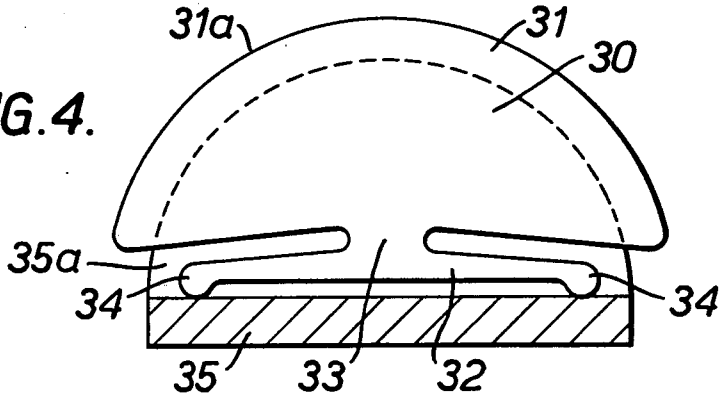
FIG. 4 diagrammatically shows a modified blade for an alternative shaver construction.

A modified blade construction is shown diagrammatically in FIG. 4. This blade 30 is intended for use in a shaver having a longitudinally reciprocating inner cutter beneath a cylindrically curved foil. This blade 30 is received in transverse slots 35*a* in the cutter body 35.

The blade 30 consists of an outer rigid sector-shaped part 31 and an inner resilient generally straight arm 32, the two parts being connected by a bridge 33. The resilient inner arm is provided at its free ends with projecting abutments 34 for pressing against the bottom of the transverse slots 35*a* in the cutter body when the foil head is applied to the shaver casing, whereby the resilient arm is deformed and by reaction the cutting edge 31*a* of the rigid part is urged into engagement with the foil of the second foil head.

Various modifications of the above-described arrangements are possible within the scope of the invention. In particular, it will be clear that the first construction of blades may be applied to a shaver in which the inner cutter is driven in continuous rotation beneath a cylindrically curved foil. In this case blades will be provided around the whole circumference of the cutter body, suitable clips again being provided to ensure retention of the blades and the leading lateral edge of the foil, in the directions of rotation of the cutter head, being shaped and positioned to meet the projecting cutting edges tangentially to the path of movement thereof.

I claim:

1. In an electric shaver having a shaving foil which is removable from the shaver and a movable inner cutter cooperating therewith, wherein the inner cutter comprises a cutter body having slots therein and a plurality of cutter blades mounted in the slots, the improvement wherein each cutter blade comprises integrally formed first and second parts lying in a single plane, the first part having a cutting edge and the second part being resiliently deformable relative to the first part in the plane of the blade and being pressed against the cutter body to be deformed towards the cutting edge by assembly of the inner cutter beneath the shaving foil to resiliently urge the cutting edge of the first part of the cutter blade into engagement with the foil and the cutter body is provided with retaining means engaging the first part for retaining the blades in the slots when the shaving foil is removed from the shaver.

2. An electric shaver according to claim 1, wherein the resiliently deformable second part is provided with abutments projecting in the plane of the blade away from the cutting edge and for cooperation with the bottom of the slots in the cutter body.

3. An electric shaver according to claim 1, wherein the first part of each blade is a rigid part carrying the cutting edge, the second part of each blade comprises a resilient arm, and each blade further comprises a central bridge connecting the rigid first part with the center of the resilient arm, said first part, second part and central bridge all being coplanar.

4. An electric shaver as claimed in claim 3, wherein the resilient arm has free ends and tapers in width from the central bridge towards its free ends so that when deformed said resilient arm is subject to substantially uniform bending strain along its length.

5. An electric shaver according to claim 3, wherein the inner cutter is mounted for arcuate oscillation or rotation beneath cylindrically curved foil, and the first part of each blade comprises a substantially straight rigid arm carrying the cutting edge connected through the central bridge to the resilient arm of the respective second part, the resilient arm of each second part comprising a substantially straight resilient arm extending in parallel coplanar relationship to the rigid arm.

6. In an electric shaver comprising a movable inner cutter including a cutter body having slots therein, a plurality of cutter blades mounted in the slots, and cutter blade retaining means; and an outer removable shaving foil, the improvement wherein each of said cutter blades comprises:

integrally formed coplanar first and second parts, the first part being substantially rigid and being formed with a cutter edge for cooperation with the foil, and the second part being resiliently deformable relative to the first part, towards the cutting edge in the plane of the blade, said first part including engaging means for engaging the cutter blade retaining means of the cutter body to retain the cutter blades in the slots when the shaving foil is removed from the shaver.

7. A cutter blade according to claim 6, wherein the first part of each blade is a rigid part carrying the cutting edge, the second part of each blade comprises a resilient arm, and each blade further comprises a central bridge connecting the rigid first part with the center of the resilient arm, said first part, second part and central bridge all being coplanar.

8. A cutter blade according to claim 7, wherein the resilient arm has free ends and tapers in width from the central bridge towards its free ends so that when deformed said resilient arm is subject to substantially uniform bending strain along its length.

9. A cutter blade according to claim 6, wherein said first and second parts comprise a stamping from a flat metallic sheet.

10. A cutter blade according to claim 6, made of tempered steel.

11. A cutter blade according to claim 6, made of beryllum-bronze alloy.

* * * * *